United States Patent [19]

Russo et al.

[11] 4,316,298

[45] Feb. 23, 1982

[54] COMPOSITE MATTRESS SYSTEM

[75] Inventors: Joseph L. Russo; Richard Sonder, both of New York, N.Y.

[73] Assignee: Thonet Industries, Inc., York, Pa.

[21] Appl. No.: 129,620

[22] Filed: Mar. 12, 1980

[51] Int. Cl.[3] ..... A47C 27/22; A47C 27/15; A47C 31/08

[52] U.S. Cl. ..... 5/465; 5/466; 5/481

[58] Field of Search ..... 5/481, 466, 464, 448, 5/470, 465; 428/310, 315; 297/DIG. 1

[56] References Cited

U.S. PATENT DOCUMENTS

| | | | |
|---|---|---|---|
| 278,005 | 5/1883 | Smith | 5/466 |
| 2,616,486 | 11/1952 | Hawley et al. | 5/481 |
| 3,051,601 | 8/1962 | Shick | 5/481 |
| 3,118,153 | 1/1964 | Hood | 5/481 |
| 3,310,300 | 3/1967 | Lawson | 5/481 |
| 3,323,152 | 6/1967 | Lerman | 5/481 |
| 3,419,920 | 1/1969 | Maddux et al. | 5/464 |
| 3,846,857 | 4/1974 | Weinstock | 5/464 |

FOREIGN PATENT DOCUMENTS

| | | | |
|---|---|---|---|
| 223748 | 12/1942 | Switzerland | 5/466 |
| 1557967 | 12/1979 | United Kingdom | 5/481 |

*Primary Examiner*—Alexander Grosz
*Attorney, Agent, or Firm*—C. Hercus Just

[57] ABSTRACT

A mattress assembly and system adapted for specialized use where bending is required and comprising a top pad formed of two layers of relatively soft foamed plastic between which a load-distributing mesh sheet is bonded to also secure said layers together, in combination with a bottom pad of much firmer foamed plastic coextensive with and underlying the top pad and capable of preventing the assembly and system of pads from bottoming-out. The bottom pad also is connected to the top pad in a manner to prevent relative longitudinal movement therebetween, especially when the assembly and system are bent at localized locations incident to the mattress support on a bed being similarly bent such as in hospital use and in domestic convertible sofas.

14 Claims, 7 Drawing Figures

COMPOSITE MATTRESS SYSTEM

BACKGROUND OF THE INVENTION

The present invention pertains to a composite mattress system and, more particularly, to such a system which is primarily for institutional use, such as in hospitals, nursing homes and the like, and it is also adapted for domestic use, such as in convertible sofas. In institutional type mattresses, it is well-known that the supporting springs or pans on beds used in hospitals and similar institutions, require bending or flexing of the mattresses due to the supporting spring sections or pans being articulared and relatively movable between, for example, a relatively flat condition and one in which the mattress sections or pans are disposed at angular relationships, such as supporting the back of a patient at an angle to the horizontal, having the knees raised, or in some situations, even having the supporting sections of the bed disposed somewhat as a chair. All of these arrangements usually require that the mattress be capable of being folded along the lines where the springs or pans are flexibly connected for disposing the same in desired angular relationship, and in convertible sofas, similar or even more acute reverse folding also is required.

It also is a desirable factor that the mattresses be comfortable, even though subjected to bending at the articulated connection of the bed spring or pans, and in order to provide adequate comfort, it has been customary to employ mattresses of reasonable thickness, such as of the order of five or six inches or more. Attempting to bend or fold mattresses of this thickness however, presents problems, such as inability to conform closely to the angularly related sections, particularly at the location where the mattress is bent, or the mattress becomes puckered and over a period of time, becomes worn in the sections where it is bent. Further, if a mattress of the exemplary thickness referred to above is not used, and instead, a thinner mattress is employed which would readily be subjected to bending, the thin nature of such mattresses minimizes comfort to the occupant of the bed due to, for example, the mattress "bottoming-out", which is a term commonly known in the mattress industry and refers to the situation where the imposition of a weight, such as a human body upon the mattress, initially is cushioned but, depending upon the amount of the weight, said weight often compresses the mattress to an extent that no further resilience is offered and the support is the same as if the mattress were simply a rigid, immovable surface. The ideal arrangement is one in which when the weight applied to the mattress reaches stability, there is still at least a limited amount of further yieldability and a sensation of contacting an immovable surface is not present.

THE PRIOR ART

Many attempts have been made heretofore to solve the problem defined above, particularly in an effort to achieve suitable comfort, with the mattress being susceptible to bending and at least reasonably free from "bottoming-out". Some of the prior attempts are found in the following patents, as follows:

U.S. Pat. No. 3,663,973 to Spence, dated May 23, 1972, shows a cushion structure in the nature of a mattress in which two layers of non-porous gel have a Dacron mesh imbedded in the gel between the layers, said layers of gel being enclosed within a suitable cover of stockinette material and this, in turn, is enclosed in a waterproof casing, such as pure latex rubber.

U.S. Pat. No. 3,310,300 to Lawson, dated Mar. 21, 1967, discloses a load-bearing unit, such as used in a seating structure and comprises a metal frame across which a sheet of mesh of woven wool or other types of strands extend and at the edges thereof is secured to said frame. The mesh is disposed between a relatively thick upper portion and a thinner lower portion of foam plastic material and it appears that the mesh is embedded within the material rather than extending between two layers thereof.

U.S. Pat. No. 3,323,152 to Lerman, dated June 6, 1967, is directed to a body support comprising layers of polyurethane foam between which a perforated sheet of plywood $\frac{1}{4}$ inch in thickness extends to stiffen the support, the layers of polyurethane being sealed at the edges but are not fixed to the sheet of plywood stiffener.

U.S. Pat. No. 3,553,749 to Majeske, dated Jan. 12, 1971, discloses an impact cushion of a laminated nature in which a low density, softer upper layer is connected by adhesive to a much thinner lower layer which is of a firmer high density foam plastic, the cushion primarily being intended for use as an impact means for unloading beer kegs from trucks, etc. A cover of vinyl sheeting or woven fabric, such as canvas, encloses the laminated foam plastic cushion structure.

U.S. Pat. No. 3,757,365 to Kretchmer, dated Sept. 11, 1973, discloses a pillow of polyurethane foam layers, the upper one being softer than the bottom layer, and the upper one being much thicker than the bottom layer, said layers being cemented together.

Lastly, U.S. Pat. No. 3,846,857 to Weinstock, dated Nov. 12, 1974, shows a multi-section variable density mattress comprising three zones of different densities, super-imposed upon a plywood base sheet, the lower foundation section comprising a plurality of members in end-to-end relationship, which include the plywood foundation and upon which a relatively thin foamed plastic sheet is attached, having a relatively high density for firmness. A composite mattress of upper and lower slabs, respectively of high density and low density for top firmness and lower softness is enclosed in the cover and disposed upon the foundation sections for articulation upon a hospital bed. The mattress is stated to be approximately six inches thick and the firm foam plastic slab upon the foundation plywood member is stated to be approximately two inches thick.

SUMMARY OF THE INVENTION

The basic objective of the present invention is to provide a mattress system which includes minimum thickness without sacrifice of comfort in order that the mattress readily may bend as, for example, when used in hospitals, the mattress readily will conform to an articulated bed structure, such as a relatively rigid series of articulated pans or link spring sections when disposed in various angular relationships to best suit the comfort or need of a patient. The mattress preferably is formed from two layers of foamed synthetic resin material which is of relatively low density for softness, said layers being either of the same or relatively close degrees of density and said layers are bonded to an intermediate sheet of mesh of highest tensile strength, one suitable type of material comprising Nylon for purposes of distributing the weight and particularly when concentrated loads are imposed upon the mattress especially by the buttocks of a human body, thereby aiding in minimizing said mattress to "bottoming-out", especially when the mattress is supported upon a bed in which sheet metal pans or link spring sections have relatively little yieldability.

Ancillary to the foregoing object, it is an additional object to support the aforementioned mattress upon a bottom pad of substantially less thickness than the mattress described above and preferably comprised of hingedly connected sections of preferably uniform thickness of much higher density foam synthetic resin to provide substantially greater firmness than the mattress and, in association with the mattress, affording still further capabilities of preventing, or at least minimizing, "bottoming-out" when the assembled mattress or top pad and said bottom pad are supported upon a bed structure affording little, if any, yieldability.

A further object of the invention is to adapt the mattress and bottom pad referred to above to institutional use, such as hospitals and nursing homes, or the like, but it is obvious that such a mattress system can be employed with equal facility for domestic purposes, such as in sofas convertible to a bed, which require substantial folding transversely into a plurality of overlying sections when in stored position within a sofa.

Foam mattresses of limited thickness, when placed on a relatively unyielding surface, tend to "bottom-out" easily due to being incapable of resisting further compression until the unyielding supporting surface actually provides the support for a human body. "Bottoming-out" has been minimized heretofore by increasing the thickness or increasing the density of the foam of the mattress. Increased thickness tends to give an unstable floating feeling when low density foam is used. Increased density reduces mattresses or upholstry confort because the foam surface does not conform easily to the irregular shape of the human body. Mattresses which use a layer of low density foam over a layer of high density foam have been marketed but have not proven superior or desirable over other forms of foam mattresses. As a result, most foam mattresses now in use have a minimum thickness of four or five inches. Foam mattresses of this type are used on institutional beds but many such beds still use interspring mattresses. For other hospital equipment, such as stretchers, operating tables, and the like, it is somewhat common to use foam mattresses of four inch thickness but only limited comfort is expected from such pads.

The thicker the mattress, the greater the weight, the more difficult to handle the same, the greater the cost of material, the more difficulty to conform to irregular or articulating forms and the lesser freedom for design purposes. Conversely, the thinner the mattress, the lighter the weight, the easier to handle, the lesser the cost of material, the easier to conform to irregular or articulating forms, and the greater possibility of design.

Designing mattresses for institutional use, such as in hospitals and nursing homes, presents specialized problems in view of the fact that bed surfaces articulate and bend at angles up to 60°. Thick mattresses are unable to conform to the bending of such bed surfaces and instead, they bend on a larger radius and this action tends to push the patient toward the foot of the bed, thus generating the requirement for increased bed length and greater areas in hospital rooms. A thinner mattress aids in overcoming this problem for either domestic or institutional use.

The weight of mattresses adds to the difficulty of making up the bed and changing sheets, cleaning the bed, moving the bed, and moving the mattress to decontamination areas. A light, relatively thin mattress helps to overcome these problems. Relatively thick mattresses also cause difficulty in achieving a low position for the bed to enable a patient to exit the bed safely; adds to the amount of material required to be used for bed linen; adds to the volume of hospital laundry needs; and tends to deform under weight more easily at the mattress edge, causing the patient to roll out of the bed. A thinner mattress obviates or minimizes most of the foregoing difficulties.

Ideally, a mattress, for either domestic sofa beds or institutional type beds, should have a limited thickness to allow the mattress to bend and conform closely to bed articulation and the same also should be capable of flexing in two directions, especially since most institutional beds afford a knee break which allows the foot end to drop from the horizontal and correspondingly, the part which supports the back of the patient normally extends angularly upward from a horizontal position, thereby bending oppositely from the foot end of the bed. The thickness should be sufficient to perform properly without any additional resiliency-providing backup and, due to the fact that link spring sections in institutional beds are difficult to clean, abrade mattresses and make mattress movement for transfer very difficult, metal pan sections of an articulated nature generally are preferred over link spring sections and, if desired, may be covered with layers of high density foam of very limited thickness or covered with seamless vinyl fabric.

In addition to a mattress system being used by patients while resting or sleeping, it is preferable that they also may be used as a transfer device, especially for transfer to radiology equipment and by making the mattress of radiolucent material, a patient need not be subjected to painful movement. Accordingly, interspring mattresses are unacceptable for such purposes and by employing non-metallic substances in the entire mattress system or at least in those are s which would be subjected to radiology equipment, such mattress systems will serve a dual function.

In addition to the above-described objects of the invention, particularly for purposes of providing a mattress system highly capable of meeting the requirements of minimum thinness without sacrifice of comfort, further objects of the invention are to cover the composite mattress or top pad with sheet material of water and stain resistant qualities, as well as being bacteria resistant and non-allergenic, one such suitable material being merchandised under the trademark "HERCULITE". It has been found, however, that such material has a certain amount of undesirable reaction with the foam plastic of the mattress layers, such as when formed from polyurethane, and in order to minimize or prevent such occurrence, barrier pads or layers of minimum thickness are disposed between at least the top and bottom cover areas and the adjacent surfaces of the foam plastic layers enclosed in said cover; one suitable type of barrier pad being a mixture of polypropylene glycol and toluene diisocyanate to render the cover compatible with the foam of the pads.

Still further, another objective of the invention is to provide appropriate handle structures, especially for the mattress composed of the composite layers of foam plastic, and one highly suitable form is to employ fabric tapes of limited width extending transversely between opposite sides of the mattress adjacent the mesh sheet between the upper and lower layers of foam synthetic resin, the opposite ends of said tape preferably extending beyond the side edges of the mattress and, if desired, may be arranged in loop form to facilitate the use thereof as handles and at least a pair of said tapes are employed in each mattress at longitudinally spaced positions therein.

One further object of the invention is to employ stabilizing mechanism between at least certain of the sections of the bottom pad of relatively firm foam synthetic resin and localized areas of the mattress and one highly satisfactory type of such stabilizing means comprises strips of non-metallic, interengageable and readily detachable plastic fastening means, one commercial variety thereof being sold under the tradename "VELCRO", said attaching means preferably being attached to the intermediate section of the bottom pad and the corresponding section of the mattress or top pad, preferably at the opposite ends of the intermediate sections of said pads, whereby when a human form is disposed upon the top and bottom pads in use, and either the back-supporting section or the leg-supporting section is moved angularly with respect to the intermediate, usually horizontal section, suitable movement of a sliding nature may occur between the mattress supporting means of the bed, such as metal pans, and the sections of the bottom pad which are disposed thereon, as well as between the corresponding end sections of the top and bottom pads.

Many of the foregoing objects also readily apply to mattresses for use in convertible sofas so that the relatively extreme bending of 180° extent may be accomplished while not sacrificing comfort when the mattress and sofa frame and extended for bed use. However, certain of the improvements may not necessarily apply to this type of domestic use.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

As set forth above, the principal purpose of the present invention is to provide a mattress highly adapted to be subjected to bending and/or folding, such as respectively found in institutional type beds such as hospitals, and also in sofa beds for domestic use. In order to accomplish this and simultaneously prevent "bottoming-out" to provide maximum comfort while minimizing the thickness of the mattress assembly in order to obtain the desired properties of bending and folding, a combination of different types of foamed plastics has been devised as described in detail hereinafter.

It also is preferred, especially for institutional type use, that mattresses be covered with flexible material that is water and stain resistant, as well as being antistatic, non-allergenic and also flame-retardant. In seeking a suitable covering material having the foregoing properties, one was selected which has been found to cause migration of plasticizer from certain types of desired foam plastics to be used in the body of the mattress and thus, it has been necessary to develop a suitable relatively thin barrier pad of foam plastic between such covering material and the foam body of the mattress to minimize or prevent such migration of plasticizer. All of this has been accomplished in the mattress described hereinafter, which employs the principles of the invention, in combination with certain structural features which have been included in order to provide maximum comfort with minimum thickness of the overall assembly and minimize, if not eliminate, "bottoming-out" of the assembly, especially when subjected to concentrated loads of normal amount.

Figure 1:
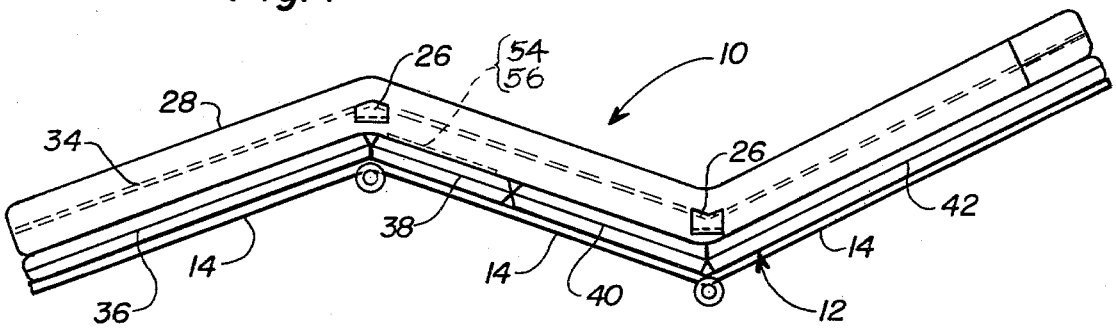
FIG. 1 is a side elevation of an exemplary arrangement of the top and bottom pads of the mattress system of the present invention supported upon articulated base members of a conventional nature on a hospital bed, the details of the bed being omitted in such view.

Referring to the drawings, an exemplary illustration of an institutional type mattress embodying the present invention is shown in side elevation in FIG. 1. This mattress assembly comprises a composite type top pad 10 and a bottom pad 12, which is directly abutted by the top pad and, in conventional institutional type beds, such as in hospitals and the like, the superimposed top and bottom pads are supported upon either a plurality of hingedly-connected pans 14 or spring sections of conventional type employed in such institutional type beds. The composite top pad 10 is illustrated in detail in FIGS. 2, 4 and 5, while the bottom pad is shown in detail in FIGS. 3 and 6.

Figure 4:
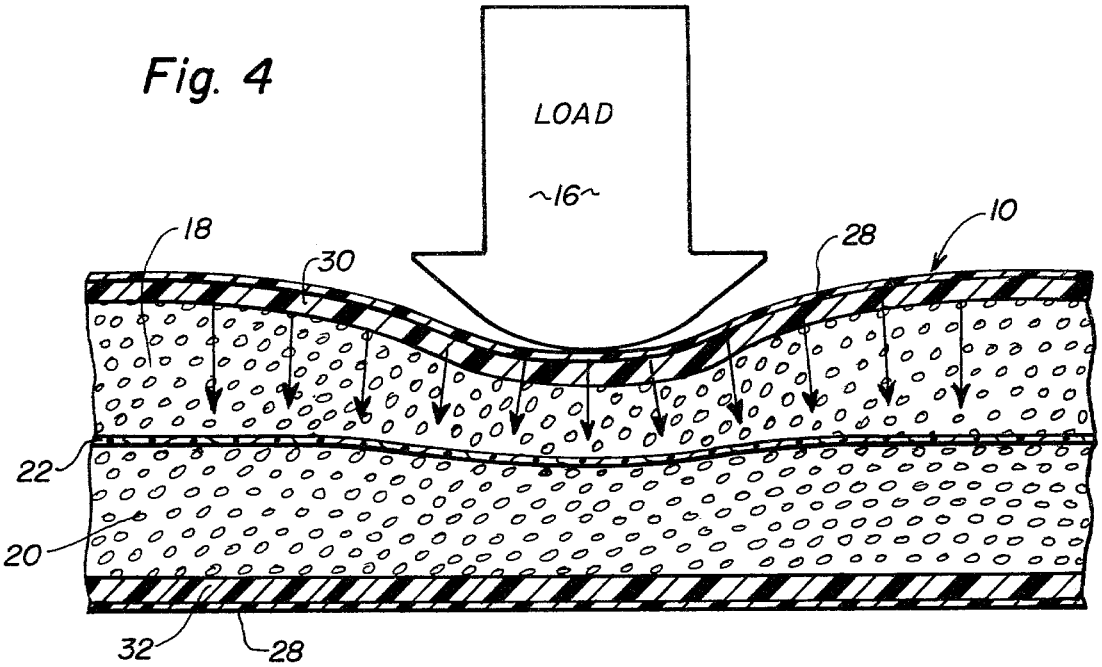
FIG. 4 is a fragmentary, somewhat diagrammatic disclosure, illustrating the distribution of said load upon the mattress of the invention shown in FIGS. 1 and 2.

Referring to FIG. 4, in which an enlarged fragmentary transverse section of the top pad 10 is shown, and exemplary concentrated load 16 is shown, and the figure primarily is provided to show the disposition of forces from said load upon the composition of the composite top pad which is of special construction in accordance with the invention for purposes of distributing the forces of such concentrated load in a manner to contribute to the minimizing or elimination of "bottoming-out", which, as set forth hereinabove, is a term well-known in the mattress and upholstery trade. For example, when a mattress or cushion "bottoms-out", the load meets a relatively immovable surface, and no further cushioning effect exists. Contrarywise, the elimination of "bottoming-out" results in an applied load, such as a human body, not having the sensation of resilience or cushioning reaching zero effect. In other words, when the application of the load to the mattress comes to a rest position, there is still a sensation of further cushioning existing with respect to the load, and it is this sensation that the present invention has been devised to provide.

Part of the minimizing of "bottoming-out" is achieved by the top pad 10 and additional effect is provided by the bottom pad 12, whereby the two pads operate in conjunction with each other to achieve the desired ultimate result.

Considering the details of the top pad 10 as illustrated in FIG. 4, for example, it will be seen that said pad is composite, and is composed of an upper layer 18 of foam plastic having a density rating of preferably between HR17 and HR27, which densities are less firm than the density of the foam plastic employed in the bottom pad 12, which is set forth below, in detail. The upper layer 18 is superimposed upon a lower layer 20 of foam plastic, said layers preferably being of equal thickness, specific examples of which are set forth hereinafter. Sandwiched between the upper and lower layers 18 and 20 is a mesh layer 22, which is woven or otherwise formed from polypropylene filaments, said netting having a mesh preferably less than one-fourth inch in size and said netting and the adjacent surfaces of the upper and lower layers 18 and 20 are firmly bonded by appropriate cement compatible with the chemical composition of the foam plastic and mesh layer 22. By this construction, the upper and lower layers are united with each other. The function of the mesh layer is to assist in distributing compression of the upper layer of foam plastic 18 to the layer 20. To assist in such distribution and also provide maximum resilience, the plastic preferred to form the foam layers 18 and 20 comprises a mixture of polypropylene glycol and toluene diisocyanate. These compounds are furnished preferably in a 2:1 ratio and in addition, a suitable catalyst is mixed therewith, together with a plasticizer, such as silicone, conventional blowing agents and fire-retardants also being included in suitable proportion. Further to provide maximum resiliency, the foregoing composition includes a mixture of acrylonitrile and styrene in a proprietary formulation which provides the foamed plastic with maximum resilience, and in doing so renders said foamed plastic very expensive to produce, as compared with other foamed plastics that are employed in a less expensive type of mattress, which has inferior resilience.

Figure 2:
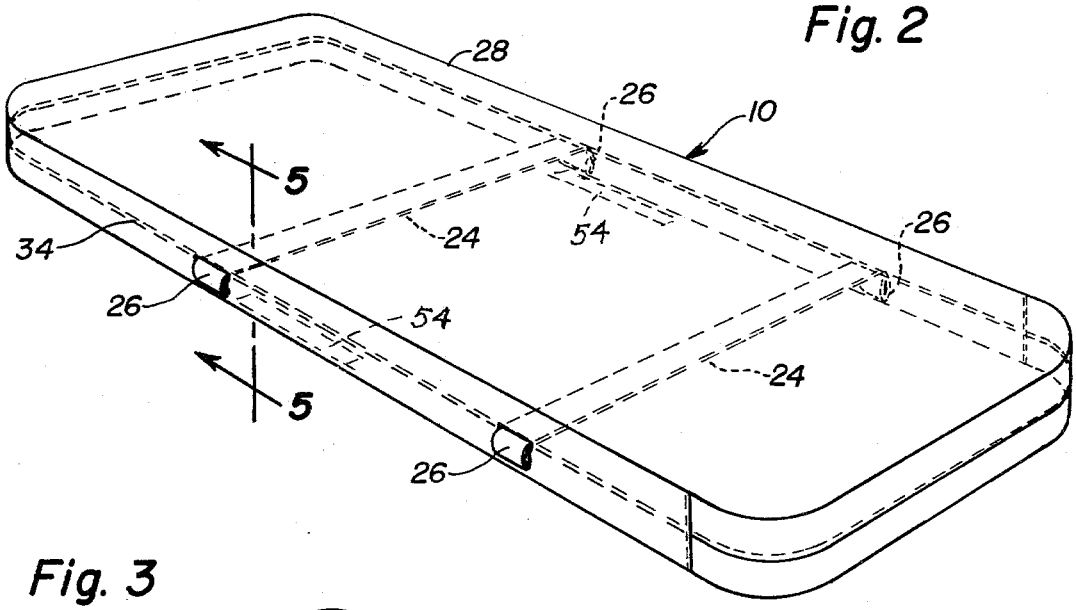
FIG. 2 is a perspective view of a mattress comprising the top pad of a mattress system embodying the principles of the present invention.

The top pad 10 also is provided with a handle structure in the form of a single or a plurality of superimposed woven tapes 24, which extend between opposite sides of the mattress 10, as shown in FIG. 2, and loops of said tapes extend beyond the opposite sides of the mattress to provide appropriate loop-type handles 26. The tape 24 is applied incident to laminating the upper and lower layers 18 and 20 with each other and the mesh layer 22, and the same type of cement may be employed to effect connection of the tapes to the foam layers, as well as the mesh 22. Without restriction thereto, one type of tape which has been found to be highly appropriate is composed of 75% polyester and 25% Nylon.

In mattresses of institutional types, such as used in hospitals and the like, it is essential that the same be provided with a suitable cover. An exemplary cover 28 is shown in FIGS. 1, 2, 4 and 5. A preferred fabric for such cover comprises a commercial product sold under the trademark HERCULITE. Said fabric has a proprietary formulation but essentially is a woven open mesh fabric formed from polyvinyl chloride, reinforced with Nylon scrim, said open weaves crim being impregnated with the polyvinyl chloride and the product is provided with appropriate proprietary compounds and formulations to render the same flame-retardant, non-allergenic, anti-static and especially being water and stain resistant.

It has been found in practice that the highly desirable covering described above exhibits a tendency, when placed directly in contact with the foamed plastic from which the upper and lower layers 18 and 20 are formed, to effect migration of the plasticizer from the foam plastic and actually render the same relatively brittle. In view of the desirability, however, of using this type of covering with the plastic material of the upper and lower layers 18 and 20 without resulting in such migration of the plasticizer of the foam plastic, the present invention employs barrier layers 30 and 32 of foam plastic of limited thickness which essentially is the same basic formulation as that from which the upper and lower layers 18 and 20 are formed except that the acrylonitrile and styrene additives in said layers are not present in the barrier layers 30 and 32 in that it has been found that no noticeable migration of plasticizer in the barrier layers 30 and 32 occurs when in direct contact with the cover fabric 28.

Figure 5:
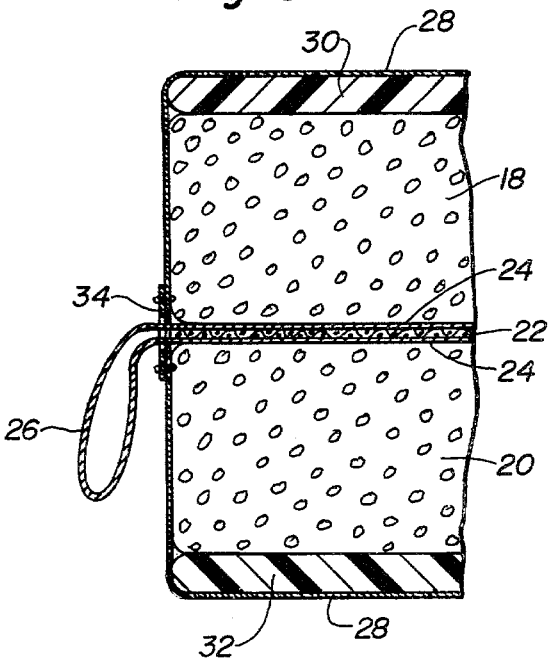
FIG. 5 is an enlarged, fragmentary, vertical section of the mattress or top pad as shown in FIG. 2 and seen on the line 5—5 thereof.

The top and bottom sheets of the cover 28 are bent to extend along the sides of the composite body of the top pad 10 of the mattress assembly so as to meet substantially adjacent the edges of the mesh layer 22 and said side edges of the cover 28 are connected together, preferably detachably, by any suitable means, such as a conventional zipper 34, as shown in exemplary manner in FIGS. 1, 2 and 5.

Figure 3:
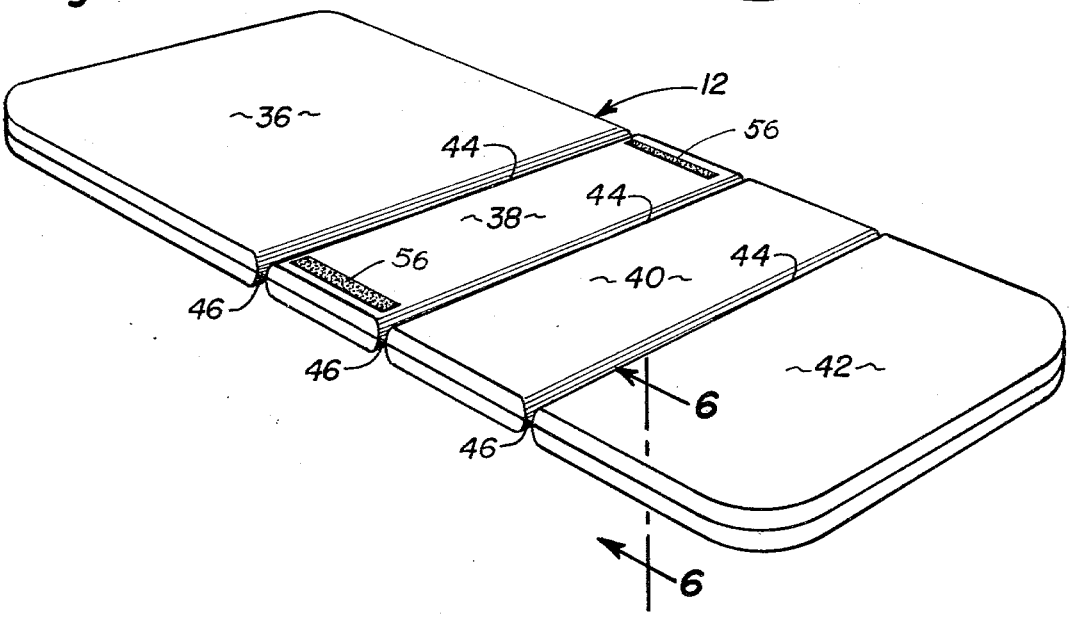
FIG. 3 is a perspective view of the bottom pad of the mattress system of the present invention and upon which the mattress of FIG. 2 is supported in use.
Figure 6:
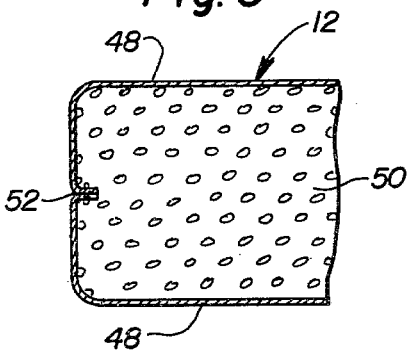
FIG. 6 is an enlarged, fragmentary, vertical section of the bottom pad shown in FIG. 3 as seen generally on the line 6—6 thereof.

For purposes of further aiding in distributing loads, especially concentrated loads, particularly for the purposes of minimizing or eliminating "bottoming-out" of the mattress assembly, an essential and very important component of the assembly comprises the bottom pad 12, details of which are best illustrated in FIGS. 3 and 6. As shown in FIG. 3, said bottom pad is composed of a plurality of articulated sections 36, 38, 40 and 42. Particularly when employed in institutional use, such as hospitals, the section 36 is the so-called leg section, and section 42 is the head or shoulder section, while the intermediate sections 38 and 40, which are shorter than the end sections 36 and 42, are illustrated in a common plane in the configurations shown in FIG. 1, but, in certain types of hospital beds, bending between the sections 38 and 40 is desired and the bed structures correspondingly are constructed to permit such bending between the sections. Spaces 44 of limited width are formed between the articulated sections of the bottom pad for purposes of providing hinges 46, which are composed of portions of the upper and lower sheets of the cover 48, which encloses the foam plastic body 50 of each of the sections 36, 38, 40 and 52. The hinges 46 may be formed either by stitching abutting portions of the upper and lower sheets of the cover together, or suitably cementing the same. Preferably, the cover 48 is formed from the same material as that of the cover 28 for the top pad 10, and the edges of the upper and lower sheets of said cover may be suitably connected, such as by stitching 52, shown in FIG. 6, or employing any other conventional connecting means.

The preferred and essential characteristic of the foam plastic body 50 of the bottom pad 12 is that it be substantially firmer than the layers 18 and 20 of the top pad 10, especially to minimize "bottoming-out" and, preferably, eliminating the same. Accordingly, the foam plastic selected is one that is identified as CS2045, which is much firmer than the upper and lower layers 18 and 20 of top pad 10 and has a density of approximately 2.0 lbs./cu.ft. Accordingly, due to the spreading of the application of a concentrated load by the top pad 10 and mesh layer 22 therein, as illustrated in FIG. 4, the much greater density and firmness of the bottom pad 12 provides a combination of related foam densities and physical construction in the assembled top and bottom pads that produces adequate comfort and minimal tendencies to "bottom-out" in a composite structure of minimum overall thickness, as follows:

By way of affording comparable dimensions and characteristics which are primarily exemplary and illustrative rather than being absolutely restrictive, sample mattresses embodying the present invention and affording the desired load distribution with maximum comfort and minimal thickness have the following dimensions:

The upper and lower layers 18 and 20 preferably are formed of HR17 and/or HR27 and are of similar thickness of substantially 1½ inch each. The barrier pads are preferably approximately ¼ inch thick and are formed of CS1530, which has a density of about 1.50 lbs/cu.ft., whereby the overall thickness of the top pad 10 is approximately 3½ inches. HR17 has a density of about 1.90 lbs/cu.ft. and HR27 has a density of about 2.7 lbs/cu.ft. The bottom pad 12 which has a unitary foam plastic body 50 is preferably composed primarily of polyurethane which is approximately 1½ inches thick. A conventional area size for institutional use in mattresses of this type comprises a width of 35 inches and a length of 80 inches. Also, the preferred linear distance between the pair of woven tapes 24 is 32 inches. As indicated, these dimensions are exemplary and may be varied within limited amounts. Similarly, while the upper and lower layers 18 and 20 of the top pad 10 have been indicated as preferably being of similar density, they need not be and, for example, the upper layer 18 may be formed of HR17 and the lower layer may be formed from HR27, or vice versa.

For comparison of firmness and softness of the layers of the top pad and the bottom pad, the HR ratings of 17 and 27 are relative to each other and CS2045 has a similar rating of 45, whereby it will be seen the bottom pad is about twice as firm as an average of the top pad layers.

Figure 7:
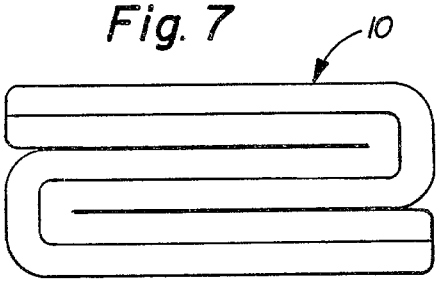
FIG. 7 is an end view of an exemplary illustration of the top mattress pad being folded in the manner in which such mattress is employed in a sofa bed.

In institutional use, one example of which is shown in FIG. 1, it will be seen that the top and bottom pads 10 and 12 are bent in accordance with the supporting means in which the sections of the hospital bed support, such as pans or springs, are disposed. Such bending may even be more accented than that illustrated in FIG. 1, such, for example, where the bottom pad and, correspondingly, the adjacent portions of the top pad, may be arranged so that the leg section 36 of the bottom pad may be depending substantially vertically, the intermediate sections 38 and 40 may be substantially horizontal, and the shoulder or head section 42 may be in a more upstanding position than shown in FIG. 1, or even vertical. However, when at least the top pad 10 is employed in a sofa bed for domestic purposes, as well as when either the top pad 10 or bottom pad 12, or both, are to be arranged compactly for sterilizing or other similar purposes, at least the top pad is disposed in an exemplary configuration, such as shown in side elevation in FIG. 7, and in which three sections of the mattress are disposed in directly overlying relationship, such as when the mattress is folded in stored position within a sofa or the sofa bed type. The thinness of the mattress, as indicated in exemplary manner above, permits such compact arrangement without deleteriously affecting the resilience and comfort afforded by the mattress. In view of the fact, however, that the space within which mattresses can be stored in such or similar manners in a sofa bed, it is essential that the mattress be relatively thin and under such circumstances employment of the bottom pad 12 and in conjunction with the top pad 10 is a sofa bed arrangement would probably render the folded and stored configuration too thick for such normal use, but it is not intended that this conclusion should rule out the possible employment of the bottom pad 12 of the type illustrated and described herein with the top pad 10 in sofa bed use if the normal cushion height of such sofa bed is sufficient to accommodate such folded section of both the top and bottom pads 10 and 12.

Particularly when the top and bottom pads 10 and 12 are employed in institutional use, it is desirable in accordance with the present invention to include stabilizing means between the same, especially to prevent relative movement therebetween in a longitudinal direction but also prevent relative movement in a transverse direction. Accordingly, as shown in FIGS. 1–3, one example of suitable stabilizing means is shown in the form of co-engageable strips of mechanical type connectors, one form of which is sold commercially under the tradename "VELCRO". It comprises areas of very small and short plastic fingers having hook-like configurations at the ends which are yieldable and when the fingers on opposite strips are compressed together, they co-engage and form a secure connection between the objects to which they are attached. When separation is desired, it is accomplished simply by pulling the strips away from each other, the yieldability of the hook-like ends on the fingers permitting such separation without injury to the same.

The exemplary illustration of co-engageable strips 54 and 56 attached respectively to the adjacent surfaces of pads 10 and 12 are of the type described above. They may be secured to said pads by sewing, cement, or any other suitable means. Also, such securing means between said pads are not to be considered restrictive but are merely exemplary both as to size and nature.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A mattress assembly adapted for extensive bending by providing minimum thickness without sacrificing comfort, said mattress comprising a generally rectangular frameless top pad including an upper layer of foamed elastomeric material of relatively low density and a lower layer of similar shape of foamed elastomeric material of relatively low density, a readily flexible mesh layer of relatively inelastic synthetic resin fibers coextensive in size with said upper and lower layers and disposed therebetween, and cement applied to and integrally bonding said mesh permanently to said layers and said layers to each other throughout the areas thereof in laminated assembly to distribute concentrated loads laterally to an area greater than that of such type of load by transmitting some of the compression of the upper layer to the lower layer by means of the distributing effect of said mesh to minimize "bottoming out" of said composite top pad, in combination with a bottom pad comprising a plurality of sections of foamed elastomeric material of substantially higher density than the foamed material of said top pad and thinner than said top pad further to prevent "bottoming-out" of the combined top and bottom pads, means hingedly connecting said sections together to form a composite foldable pad of a shape similar to said top pad, said connecting means extending transversely to the longer dimension of said pads and positioned at the desired locations of the hinged means of springs or a pan of a bed upon which the mattress assembly is to be supported, and stabilizing means between at least certain of said sections of said bottom pad and the lower surface of said top pad when mounted thereon and operable to prevent relative movement between said certain sections and said top pad in a direction longitudinally of the longer dimension of said mattress assembly.

2. The mattress assembly according to claim 1 in which the layers of said top pad have an HR density rating between 17 and 27 and said firmer bottom pad is substantially twice as firm by having a comparable density rating of about 45.

3. The mattress assembly according to claim 1 in which a plurality of pairs of flexible web strips extend transversely between the top and bottom layers of said top pad and are attached by cement to said layers and portions of said webs extend beyond the opposite sides of said top pad to form handles.

4. The mattress assembly according to claim 1 further including a cover comprising imperforate woven fabric of synthetic resin scrim impregnated with polyvinyl chloride and rendered non-allergenic, flame-retardant and anti-static.

5. The mattress assembly according to claim 1 in which said layers of foamed elastomeric material in said top pad are composed of a foamed mixture of polypropylene glycol polymer and toluene diisocyanate to which suitable catalyst, blowing agents and fire-retardants are added.

6. The mattress assembly according to claim 1 in which the adjacent transverse edges of said sections of said bottom pad are slightly spaced from each other and are connected together by a flexible cover closely conforming to all surfaces of said sections and the portions of said cover which overlie the top and bottom surfaces of said sections extend respectively into said spaces between the adjacent edges of said sections and abut each other and are connected together to form short hinge means between said sections, and said cover being formed from water and stain-resistant fabric material.

7. The mattress assembly according to claim 1 in which said top pad is substantially twice as thick as said bottom pad and the density of the foam of said top pad being less than half the density of said bottom pad, similar covers of water and stain-resistant material covering both of said pads and the cover of said bottom pad forms said means which hingedly connect the sections of said bottom pad.

8. The mattress assembly according to claim 1 in which the elastomeric material of said pads is a foamed mixture of polypropylene glycol polymer and toluene diisocyanate, said mesh layer is formed of polypropylene filaments, and said top and bottom pads are covered with textile fabric comprising polyvinyl chloride reinforced with Nylon scrim, and said assembly further including between the top and bottom surfaces of said top pad and covering fabric relatively thin barrier pads of a foamed mixture of polypropylene glycol and toluene diisocyanate and suitable catalysts, said barrier pads minimizing any chemical interaction between said covering material and the adjacent surfaces of said top pad.

9. A flexible composite pad adaptable for use in a mattress or upholstery assembly and otherwise adapted for extensive bending by providing minimum thickness without sacrificing comfort, said pad being frameless and generally rectangular and including an upper layer of foamed elastomeric material of relatively low HR density rating between substantially 17 and 27 and a lower layer of similar shape of foamed elastomeric material of relatively low HR density rating similar to said upper layer, a mesh layer of flexible relatively inelastic synthetic resin fibers coextensive in size with said upper and lower layers and disposed therebetween, and cement means integrally bonding said layers to each other and bonding said mesh to said layers permanently throughout the areas thereof in laminated assembly to distribute concentrated loads laterally to an area greater than such type of load by transmitting some of the compression of the upper layer to the lower layer by means of the distributing effect of the mesh layer securely bonded thereto, whereby said distribution of compression of said layers minimizes or prevents said pad from bottoming out.

10. The flexible pad according to claim 9 in which said elastomeric material of said layers is a foamed mixture of polypropylene glycol polymer and toluene diisocyanate and said mesh layer being formed from polypropylene filaments.

11. A flexible pad according to claim 9 and further characterized as being of readily foldable nature capable of being folded into a substantially compact flat Z-shape of multiple overlying segments for storage within a sofa bed and the like and extendable from such condition to serve as a flat mattress for such bed.

12. The flexible pad according to claim 11 further including a cover closely enclosing all surfaces of said pad and formed of textile fabric, and also including between said cover and the top and bottom surfaces of said pad relatively thin barrier pad coextensive in size with said surfaces of said pad and formed of a foamed mixture essentially comprising polypropylene and operable to minimize chemical interaction between said covering material and the adjacent surfaces of said top pad.

13. The flexible pad according to claim 12 in which said elastomeric material of said layers is a foamed mixture of polypropylene glycol polymer and toluene diisocyanate and said mesh layer being formed from polypropylene filaments.

14. A flexible pad according to claim 13 further characterized by said layers being of foamed plastics of relatively low density rating between substantially 1.90 and 2.7 lbs./cu.ft.

* * * * *